US006029808A

United States Patent [19]

Peck et al.

[11] Patent Number: 6,029,808

[45] Date of Patent: Feb. 29, 2000

[54] PRIMARY PACKAGE FOR CONTACT LENS

[75] Inventors: James Malcolm Peck; Gary L. Collins; Jerry Wayne Dukes; Gregory Scott Duncan; George E. Himes, all of Jacksonville, Fla.; Kornelis Renkema, Nuenen, Netherlands; Michael J. Tersak, Jacksonville, Fla.; Donnie Jerome Duis, Jacksonville, Fla.; Ranganath Ramakrishnan Raja, Jacksonville, Fla.

[73] Assignee: Johnson & Johnson Vision Products, Inc., Jacksonville, Fla.

[21] Appl. No.: 09/239,649

[22] Filed: Jan. 29, 1999

[51] Int. Cl.[7] ..... B65D 81/22

[52] U.S. Cl. ..... 206/210; 206/5.1

[58] Field of Search ..... 206/5.1, 210, 461; 264/2.6; 422/300

[56] References Cited

U.S. PATENT DOCUMENTS

| | | | |
|---|---|---|---|
| D. 356,889 | 4/1995 | Abrams et al. | D3/264 |
| D. 357,115 | 4/1995 | Abrams et al. | D3/264 |
| D. 357,352 | 4/1995 | Abrams et al. | D3/264 |
| D. 357,353 | 4/1995 | Abrams et al. | D3/264 |
| D. 357,580 | 4/1995 | Abrams et al. | D3/264 |
| D. 357,805 | 5/1995 | Abrams et al. | D3/264 |
| D. 358,025 | 5/1995 | Martin et al. | D3/264 |
| D. 358,026 | 5/1995 | Abrams et al. | D3/264 |
| D. 358,027 | 5/1995 | Abrams et al. | D3/264 |
| D. 358,028 | 5/1995 | Abrams et al. | D3/264 |
| D. 358,029 | 5/1995 | Abrams et al. | D3/264 |
| D. 363,601 | 10/1995 | Abramse et al. | D3/264 |
| D. 365,679 | 1/1996 | Abrams et al. | D3/264 |
| D. 371,678 | 7/1996 | Borghorst et al. | D3/264 |
| 3,872,970 | 3/1975 | Edison | 206/532 |
| 4,269,307 | 5/1981 | LaHaye | 206/5.1 |
| 4,623,249 | 11/1986 | Grant | 356/124 |
| 4,691,820 | 9/1987 | Martinez | 206/205 |
| 4,782,942 | 11/1988 | Ashley et al. | 206/5.1 |
| 4,817,789 | 4/1989 | Paul | 206/5.1 |
| 4,897,981 | 2/1990 | Beck | 53/431 |
| 4,928,815 | 5/1990 | Paul | 206/5.1 |
| 4,986,414 | 1/1991 | Ashley et al. | 206/5.1 |
| 5,036,971 | 8/1991 | Seden et al. | 206/5.1 |
| 5,176,686 | 1/1993 | Poley | 606/107 |
| 5,396,984 | 3/1995 | Wanders | 206/5.1 |
| 5,407,062 | 4/1995 | Shannon et al. | 206/5.1 |
| 5,409,104 | 4/1995 | Lovell | 206/5.1 |
| 5,467,868 | 11/1995 | Abrams et al. | 206/5.1 |
| 5,474,169 | 12/1995 | Bauman | 206/5.1 |
| 5,488,815 | 2/1996 | Abrams et al. | 53/425 |
| 5,515,964 | 5/1996 | Bauman | 206/5.1 |
| 5,573,108 | 11/1996 | Hamilton et al. | 206/5.1 |
| 5,577,367 | 11/1996 | Abrams et al. | 53/425 |
| 5,598,919 | 2/1997 | Taylor | 206/5.1 |
| 5,609,246 | 3/1997 | Borghorst et al. | 206/5.1 |
| 5,620,088 | 4/1997 | Martin et al. | 206/5.1 |
| 5,685,420 | 11/1997 | Martin et al. . | |
| 5,697,495 | 12/1997 | Abrams et al. | 206/5.1 |
| 5,704,468 | 1/1998 | Lust et al. | 206/5.1 |
| 5,722,536 | 3/1998 | Pierce et al. | 206/5.1 |

FOREIGN PATENT DOCUMENTS

| | | | |
|---|---|---|---|
| 0 680 895 A1 | 4/1995 | European Pat. Off. | A61F 2/16 |

*Primary Examiner*—Jim Foster
*Attorney, Agent, or Firm*—Anne B. Kiernan

[57] ABSTRACT

This invention provides a blister pack comprising a base and a cover, wherein said base comprises a recess which houses a contact lens and solution, wherein the thickness of the material of said recess is less than 0.75 mm, and said recess houses less than 0.75 ml solution.

20 Claims, 2 Drawing Sheets

PRIMARY PACKAGE FOR CONTACT LENS

FIELD OF THE INVENTION

This invention relates to a primary package for a contact lens. More particularly, this invention relates to a primary package which provides cost-savings over conventional primary packages.

BACKGROUND OF THE INVENTION

Contact lenses particularly disposable contact lenses are conventionally packaged in blister packages. Blister packs or packages typically consist of two pieces: a base and a cover. The base is an injection-molded plastic which typically has a bowl-shaped, or rectangular-shaped recess for receiving the contact lens. The cover is a laminate material which typically consists of a laminate of an aluminum foil and polypropylene. Within each blister pack is a single contact lens and enough solution to prevent drying of the contact lens and to maintain the contact lens ready for use. The solution is typically a buffered aqueous solution. Typically, the amount of solution in the blister pack is between 0.8 to 5 milliliters, with most between 1 and 3 milliliters. It is important that the blister pack contain enough solution so that if there is loss of water through the blister pack during the shelf life of the blister pack, the change in concentration of the solution will not adversely affect the lens. Therefore, most blister packs put in a large excess of solution. However, blister packs have to be shipped and stored; therefore, there is a benefit to using less materials to form the blister pack and less solution within the blister pack. Additional design considerations for the blister packs include that blister packs must maintain a sterile environment for the contact lens for the shelf life of the blister pack, and, blister packs need to be designed to provide easy access to the lenses within the blister packs.

There is a need in the industry for an improved blister pack which provides all the above inexpensively.

SUMMARY OF THE INVENTION

This invention provides a blister pack for housing a contact lens and solution, said blister pack comprises a base and a cover, said base comprises a recess wherein said recess and said cover define a volume for housing said contact lens and less than 0.75 milliliters solution, and wherein said recess has a material thickness of less than 0.75 mm.

The blister pack of this invention uses less base material, and less solution and yet unexpectedly provides greater than a four year shelf life. From the data on the loss of solution through larger blister packs having greater material thickness, and conventional formulas used in the industry to predict the shelf life of packages, it would not be expected that the blister pack of this invention would provide a four year shelf life.

DETAILED DESCRIPTION OF THE INVENTION

Figure 1:
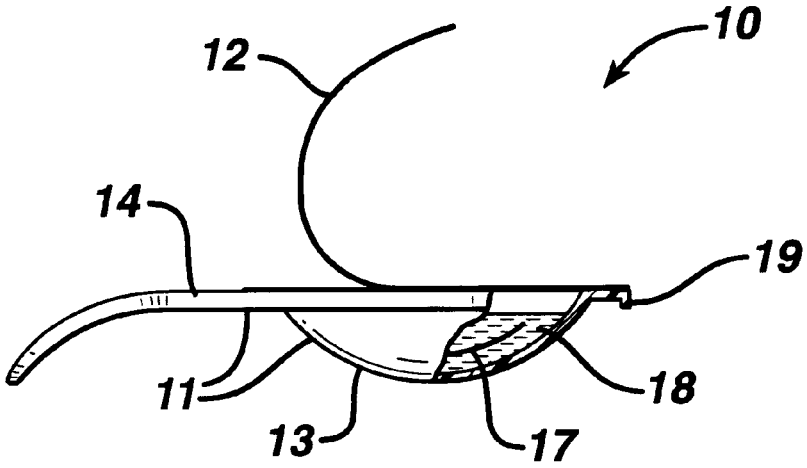
FIG. 1 is a side view of a blister pack of this invention showing a partial cross-section with the cover partially peeled back.

FIG. 1 shows a side view of a blister pack 10 of this invention with the cover partially peeled back. The partial cross-section in FIG. 1 shows that the blister pack houses a contact lens 17 and solution 18. The blister pack 10 comprises a base 11 and cover 12. The base 11 is shown having a dome-shaped recess 13, having a diameter preferably about 2.0 centimeters (cm) and an inside depth of about 0.5 cm, and a flange 14 preferably contiguous to the circumference of the recess 13, which is extended on one side to form a curled lip that is preferably tapered away from the recess. The flange preferably sticks out less than 4 millimeters (mm) from the recess, except for the tapered curled lip of the flange 14 which sticks out preferably between 16.5 and 17.5 mm from the recess. Preferably, the flange has a ridge 19 which is a thicker area of material, i.e., from 0.45 to 0.65 mm thick around most, if not all, of the exterior of the flange 14 preferably on the bottom side of the flange to provide extra support. The overall dimensions of the blister pack are approximately 2.5 cm wide, 4 cm long and 0.58 cm high. However, the base can have any shape as long as the aspects of this invention defined below are met.

The recess 13 houses a contact lens 17, and solution 18. Preferably the recess is bounded by a seal area 15 which is part of the flange 14. The cover 12 is preferably attached to the base 11 by heat-sealing in the seal area 15; however, induction-sealing, sonic welding or another bonding system can be used to attach the cover 12 to the base 11. The total interior volume defined by the recess 13 and the cover 12 is preferably less than 1 milliliter (ml), more preferably less than 0.97 ml, most preferably less than 0.94 ml. The amount of solution in this volume is less than 0.75 ml, more preferably less than 0.68 ml, and most preferably less than 0.55 ml. Preferably the solution amount is at least 0.15 ml. The solution can be any known solution useful for storing contact lenses including water, saline solutions, or buffered aqueous solutions. The contact lens and solution will preferably fill at least 50 percent, more preferably at least 70 percent, and most preferably at least 80 percent of the total volume defined by the recess and the cover.

The base is preferably formed of a plastic material which can be formed by injection molding or thermoforming. The plastic material used to make the base is preferably polypropylene, but can comprise other similar plastic materials, such as, other polyalkylenes, e.g. polyethylene, and polybutylene; polyesters, e.g. PET; polycarbonates; or other thermoplastic materials. It is preferred that the base material, particularly in the recess, has a vapor transmission of less than 10 grams/100 square inches/24 hours at 70° F. and 50 percent relative humidity. It is preferred that the thickness of the recess is less than 0.75 mm, more preferably less than 0.65 mm, and most preferably less than 0.55 mm. Preferably, the thickness of most of the base is less than 0.75 mm, more preferably less than 0.65 mm, and most preferably less than 0.55 mm, preferably over most, i.e. greater than 90% of the area, if not all of the area, of the recess. Preferably the thickness of the recess is at least 0.25 mm. It is preferred that the volume of polymer used to form the recess in the base is less than 400 $mm^3$, more preferably less than 350 $mm^3$, and most preferably less than 250 $mm^3$. For the most preferred embodiment, the volume of polymer used to form the recess is about 212 $mm^3$. It is preferred that the volume of polymer used to form the recess and the seal area in the base is less than 550 $mm^3$, more preferably less than 400 $mm^3$, and most preferably less than 340 $mm^3$. For the most preferred embodiment, the volume of polymer used to form the recess and the seal area is about 287 $mm^3$. It is preferred that the volume of polymer used to form the base is less than 750 $mm^3$, more preferably less than 650 $mm^3$, and most preferably less than 540 $mm^3$. For the most preferred embodiment, the volume of polymer used to form the base is about 532 $mm^3$.

The cover is preferably a laminate material preferably comprising a metal foil layer and at least one, preferably two polymer layers, e.g. polypropylene, coating the foil. The preferred foil is aluminum. The preferred polymer coating material on the heat seal side of the foil is polypropylene. Examples of useful covers are described in U.S. Pat. No. 4,691,820 incorporated herein by reference.

Figure 2:
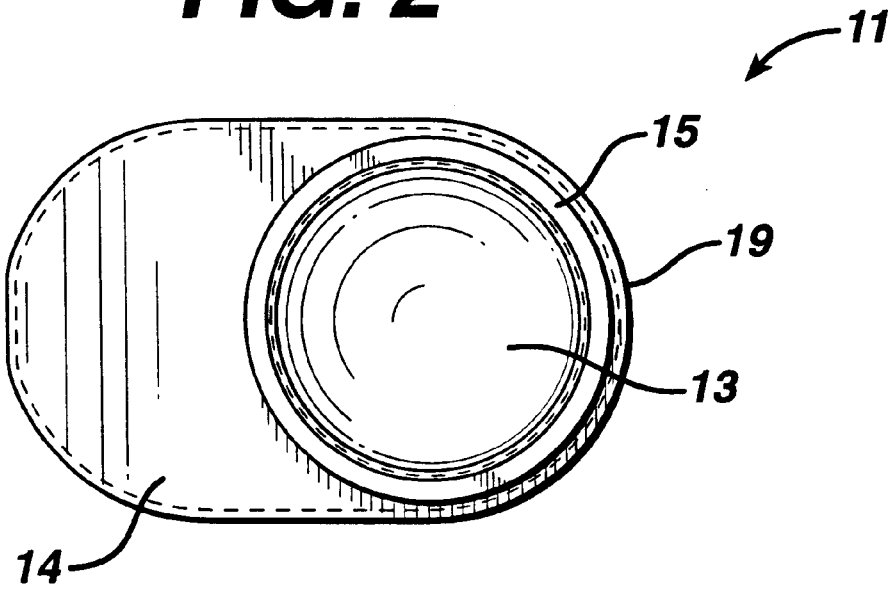
FIG. 2 is a top plan view of a base of the blister pack shown in FIG. 1 of this invention.

FIG. 2 is a top plan view of a base of a blister pack of this invention. FIG. 2 shows the seal area 15 of the flange 14 around the recess 13. The seal area preferably has a width of less than 1.7 mm, more preferably less than 1.6 mm, and most preferably less than 1.5 mm. The most preferred seal area has a width of 1.25 mm. It is preferred that the width of the seal area is thicker than the thickness of the bowl. The seal area preferably has a total area of less than 112 $mm^2$, more preferably less than 102 $mm^2$, and most preferably less than 93 $mm^2$. For the preferred embodiment, the seal area is about 85 $mm^2$. The seal area preferably has a height from the surface level of the flange of less than 0.3 mm, more preferably less than 0.275 mm, most preferably less than 0.225 mm. For the preferred embodiment, the seal height is about 0.15 mm.

The seal area characteristics described in this paragraph are measured prior to sealing the cover to the base. It was determined that a smaller height, like those just specified for the seal area of this invention, provided for more uniform sealing of the cover to the base and also required a smaller peel force. However, it was determined that a seal which required a decreased peel force could still provide a hermetic seal and sufficient protection during shipping, sterilization, and for shelf-life. The preferred peel force for the cover from the base is between 0.8 and 10 lbs., more preferably between 0.8 lbs. and 7, and most preferably between 1 and 3 lbs., as determined using an Instron® universal testing machine. It is preferred that a 0.2 to 2 mm, most preferably 1 mm head space is provided, meaning that the meniscus of the solution is 0.2 to 2 mm away from the top of the recess.

Figure 3:
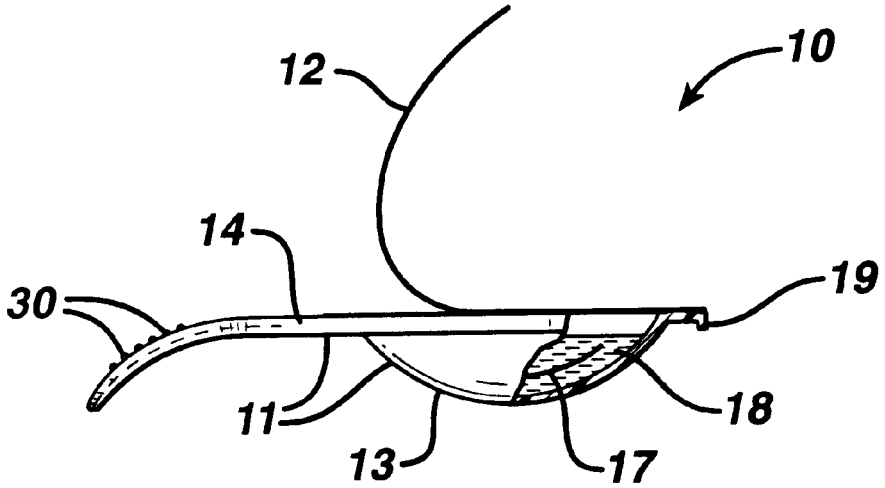
FIG. 3 is a side view of an alternative embodiment of the blister pack of this invention showing a partial cross-section with the cover partially peeled back.
Figure 4:
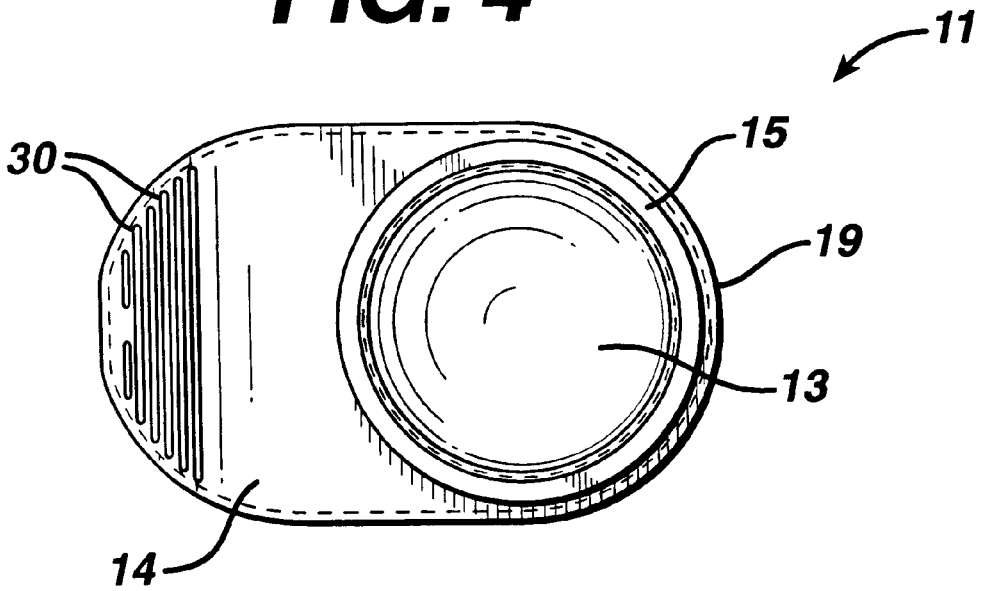
FIG. 4 is a top plan view of the blister pack shown in FIG. 3 of this invention.

FIGS. 3 and 4 show an alternative embodiment of the blister pack of this invention. All the like elements of FIGS. 1 and 2 are labeled the same. The additional element which is not shown in FIGS. 1 and 2 are the gripper strips 30 across the curled lip of the flange 14. The gripper strips or the like are preferably added to the base without significantly increasing the volume of polymer of the base.

The blister pack of this invention provides an unexpected result. It would not be expected that by decreasing the volume of solution and decreasing the wall thickness of the typical contact lens blister pack, that a contact lens blister pack could be designed which would still provide a shelf life of greater than 4 years, even greater than 5 years. At the time the design work on this blister pack was begun, the inventors believed that the maximum amount of solution that could be lost by a contact lens blister pack was only 4 percent of the solution. Assuming steady state, Fick's Law (it is common in the packaging industry particularly for food to use Fick's Law to predict the shelf life) predicts that the shelf life for a blister pack having a 0.50 mm thick bowl and 0.50 ml of solution (water) is 1.9 years. However, an accelerated shelf-life test (water loss test of the blister pack) has proven that more than 4 percent of the solution can be lost without effecting lens properties, and that the rate of water loss through the blister pack was at a much lower rate than what was predicted based on the performance of the earlier blister pack designs.

EXAMPLE 1

The preferred embodiment blister packs were used for this example. The blister pack had a wall thickness in the recess of 0.500±0.050 mm. The solution volume in the blister pack was 0.500±0.040 ml. All the blister packs contained a borate buffered saline solution and Acuvue® and Surevue® hydrophilic contact lenses. All the blister packs were manufactured by injection molding Exxon® PP1105 polypropylene resin. For the purpose of water loss evaluation, hundreds of blister packs were placed in a temperature controlled and humidity monitored environmental charter and stored at ambient conditions, that is, 23±2° C., and hundreds of blister packs were placed in a temperature controlled and humidity monitored environmental chamber and stored at accelerated conditions, that is, 45±2° C. Six data points were established at ambient and the accelerated conditions: 1 month, 3.5 months, 7 months, 10 months, 13.5 months, and 17 months. These points correspond to 0.6 years, 1 year, 2 years, 3 years, 4 years, and 5 years. Assuming first order kinetics, every 10° C. increase for the tested temperature above the normal storage temperature will enhance the expiration time or shelf life by a factor of 1.8. For example an accelerated stability study conducted at 45° C. for seven months can be expected to be suitable for prediction of a two year shelf life. [The accelerated age in months=$t_{rt}+(1.8^n \times t_a)$; where $t_{rt}$ and $t_a$ represent time, in months, at room temperature and accelerated storage respectively and $n=(T_{acc}-T_{rt})/10$, in ° C., where $T_{acc}$=accelerated temperature (45° C.) and $T_{rt}$= zoom temperature (23° C.).] This formula and explanation can be found in May 1994 FDA Guidance Document for Contact Lenses.

For each of the specified time periods the same fifty blister packs were weighed to determine the percent loss which was determined by dividing the measured weight after the specified time by the weight at the beginning. In addition, for each of the specified time periods 20 lenses from each storage condition were analyzed for parameters (base curve, diameter, center thickness and power), and chemical properties (refractive index, water content and % light transmission) to determine if any of the lens characteristics had fallen out of specification. All of the lenses were acceptable and met all physical and chemical property specifications (base curve=8.8 mm+0.2 mm; diameter=14.0 mm±0.20 mm; center thickness=0.150 mm±0.030 mm for SUREVUE −1.00D or center thickness=0.100 mm±0.030 mm for ACUVUE −9.00D; power=−1.00D±0.25D for SUREVUE −1.00D or power=−9.00D±0.25D for ACUVUE −9.00D; refractive index=1.40±0.01, water content= 58%±3%; % light transmission ≧85% and ≦95% at wavelength range of 587 nm to 599 nm) at each test interval. The vapor transfer/water loss results of the shelf-life study are as follows:

SHELF-LIFE STUDY

| Actual Time | 1 mo. | 3.5 mos. | 7 mos. | 10 mos. | 13.5 mos. | 17 mos. |
|---|---|---|---|---|---|---|
| Accelerated Time | 0.6 yrs. | 1 yr. | 2 yrs. | 3 yrs. | 4 yrs. | 5 yrs. |
| Wgt Loss 23° C. | 0.05% | 0.16% | 0.41% | 0.61% | 0.87% | 1.13% |
| Wgt Loss 45° C. | 0.05% | 0.68% | 2.94% | 4.80% | 7.20% | 9.95% |

The above example indicates that the water loss can be higher than 7%, even higher than 9.9%, and still provide lenses which are ready for use. The concern with the water loss was that the change in the composition of the buffered aqueous solution would cause the properties of the lens to change to such an extent that the lenses would not be useable.

EXAMPLE 2

A separate study on the change in solution properties was performed to test for an effect on lens properties. Using the standard buffered borate solution, seven solutions which varied between+15 percent water were made, and fifteen −3.00D 1-Day Acuvue® lenses were equilibrated in each solution for twenty-four hours after which the lens properties: base curve, center thickness, power, refractive index, and water content were tested. None of the lenses for any of the listed properties fell out of specification, even though the lens is ionic in nature and swells as a function of ionic strength of the solution. Based on this study, it was determined that the solution conductivity could range from $12\times10^3$ to $20\times10^3$ microSiemens/centimeter ($\mu$S/cm), or more conservatively between $13.2\times10^3$ to $17.2\times10^3$ $\mu$S/cm. The minimum and maximum values for the lens properties measured from the seven solutions are listed below.

SOLUTION STUDY

| PROPERTIES | TARGET | MINIMUM | MAXIMUM |
|---|---|---|---|
| Diameter | 14.20 mm | 14.00 mm | 14.40 mm |
| Base Curve | 9.00 mm | 8.80 mm | 9.20 mm |
| Center Thickness | 0.070 mm | 0.040 mm | 0.100 mm |
| Power | −3.00 D | −3.25 D | −2.75 D |
| Refractive Index at 20° C. | 1.40 | 1.39 | 1.41 |
| Water Content | 58% | 55% | 61% |

This invention and the related examples show that blister packs can be designed which allow for, greater than 8 percent, even between 10 and 15 percent water loss using decreased recess thicknesses and solution volumes and still are able to provide a shelf life of greater than 4 years, and even greater than 5 years.

The preferred embodiments have been described herein; however, alternative embodiments would be known to a person of ordinary skill in the art, which would fall within the scope of the invention defined by the claims.

We claim:

1. A blister pack comprising a base and a cover, wherein said base comprises a recess which houses a contact lens and solution, wherein the thickness of the material of said recess is less than 0.75 mm, and said recess houses less than 0.75 ml solution.

2. The blister pack of claim 1, wherein said recess houses less than 0.68 ml solution.

3. The blister pack of claim 1, wherein said recess houses less than 0.55 ml solution.

4. The blister pack of claim 1, wherein the thickness of said material of said recess is less than 0.65 mm.

5. The blister pack of claim 1, wherein the thickness of said material of said recess is less than 0.55 mm.

6. The blister pack of claim 1, wherein the thickness of said material of said recess is less than 0.65 mm, and said recess houses 0.68 ml of solution.

7. The blister pack of claim 6, wherein said recess houses less than 0.55 ml of solution.

8. The blister pack of claim 1, wherein the thickness of said material of said recess is less than 0.55 mm, and said recess houses less than 0.68 ml of solution.

9. The blister pack of claim 8, wherein said recess houses less than 0.55 ml of solution.

10. The blister pack of claim 1, wherein the volume of polymer used to form said recess is less than 400 $mm^3$.

11. The blister pack of claim. 1, wherein the volume of polymer used to form said recess is less than 250 $mm^3$.

12. The blister pack of claim 9, wherein the volume of polymer used to form said recess is less than 250 $mm^3$.

13. The blister pack of claim 1, wherein the total interior volume defined by said recess and said cover is less than 1 ml.

14. The blister pack of claim 1, wherein said base further comprises a seal area and said seal area has a width of less than 1.7 mm.

15. The blister pack of claim 14, wherein the width of said seal area prior to sealing is less than 1.5 mm.

16. The blister pack of claim 1, wherein said base further comprises a seal area, and a flange, wherein said seal area prior to sealing has a height measured from the surface of said flange of less than 0.3 mm.

17. The blister pack of claim 16, wherein said height is less than 0.225 mm.

18. The blister pack of claim 1, wherein the shelf life is greater than 4 years.

19. The blister pack of claim 1, wherein the loss of said solution through said blister pack is greater than 7% after a 4 year shelf life test.

20. The blister pack of claim 1, wherein the loss of said solution through said blister pack is between 10–15% after a 4 year shelf life test.

* * * * *